United States Patent [19]

Kleineisel

[11] Patent Number: 4,854,826

[45] Date of Patent: Aug. 8, 1989

[54] ASSEMBLY OF A PRIMARY POWER SOURCE AND SEVERAL AXIAL PISTON PUMPS FLANGED ON IT

[75] Inventor: Gustav Kleineisel, Mainaschaff, Fed. Rep. of Germany

[73] Assignee: Linde Aktiengesellschaft, Wiesbaden, Fed. Rep. of Germany

[21] Appl. No.: 187,282

[22] Filed: Apr. 28, 1988

[30] Foreign Application Priority Data

May 15, 1987 [DE] Fed. Rep. of Germany ..... 3716374

[51] Int. Cl.[4] ..... F04B 1/12; F04B 23/06

[52] U.S. Cl. ..... 417/269; 417/360; 417/426; 91/499

[58] Field of Search ..... 92/128; 91/499, 504.6, 91/506; 417/426–429, 360

[56] References Cited

U.S. PATENT DOCUMENTS

| | | | |
|---|---|---|---|
| 2,713,829 | 7/1955 | Beacham | 417/428 |
| 2,910,008 | 10/1959 | Wiesenbach | 417/429 |
| 3,602,105 | 8/1971 | Slusher | 91/505 |
| 3,847,504 | 11/1974 | Martin | 417/360 |
| 4,600,367 | 7/1986 | Terauchi et al. | 417/360 |
| 4,601,378 | 7/1986 | Pierce | 417/360 |
| 4,616,478 | 10/1986 | Jensen | 60/489 |

FOREIGN PATENT DOCUMENTS

| | | | |
|---|---|---|---|
| 3238362 | 4/1984 | Fed. Rep. of Germany | 91/499 |

*Primary Examiner*—William L. Freeh

*Attorney, Agent, or Firm*—Thomas R. Shaffer

[57] ABSTRACT

A pump assembly including a primary power source and several axial piston pumps is disclosed. A connection flange is provided on the primary power source on which a first axial piston pump is connected. At least one more axial piston pump is coaxially connected on the connection flange. In order to support the multipump assembly stress-free and pinch-free without special adjustments, it is proposed to fasten at least approximately vertical guide or support plates on at least one and preferably both sides of the first axial piston pump at the connection flange of the primary power source and to connect the plates through an intermediate flange housing with the additional axial piston pump that is connected coaxially with the first axial piston pump.

2 Claims, 1 Drawing Sheet

ASSEMBLY OF A PRIMARY POWER SOURCE AND SEVERAL AXIAL PISTON PUMPS FLANGED ON IT

BACKGROUND OF THE INVENTION

1. Field of the Invention

The present invention relates to a pump assembly including a primary power source and plural axial piston pumps. More specifically, the invention relates to such an assembly in which at least one and preferably two generally vertical guide plates support the interconnected pumps and power source in coaxial alignment.

2. Description of the Prior Art

In the assemblies of this type known to date, another axial piston pump is flanged on the housing of the first axial piston pump flanged on the connecting flange of the primary power source, and possibly another one is flanged on the second axial piston pump. The center of mass of this multipump assembly consisting of several pumps flanged on each other is at a great distance from the connection flange of the first axial piston pump, i.e., the weight and the mass forces caused by vibrations and acting on the center of mass exert a large moment on the connecting flange. Furthermore, the sum of the torques that are absorbed by the individual pumps must be conveyed through the connecting flange of the first pump. An additional torque support through a fitting pin at the connecting flange is unconventional and would lead to diffculties in the replacement of units. An attempt has also been made to support the great overall weight of the multipump assembly by providing an additional support at a definite point of the overall housing. Such an additional support requires not only a precise adjustment, but also leads to a static redundancy in determination and thus to the danger of pinching, e.g., if the support expands under the effect of heat, while different thermal expansion relationships are present on the connecting flange.

SUMMARY OF THE INVENTION

The present invention proposes a bracing-free and vibration-free support of the multipump assembly that can be readily added on without special adjustments if additional pumps are flanged onto the first pump.

According to the present invention, a pump assembly is provided including a primary power source having a primary power source connection flange thereon, a first axial piston pump attached to said primary power source flange, said first piston pump having a first pump connection flange thereon, at least one more axial piston pump coaxially connected to said first pump flange, said at least one more axial piston pump also having a connection flange thereon, a generally vertical guide plate positioned on at least one side of the first axial piston pump, said guide plate having a first end connected directly to the primary power source and having an opposite end connected to the connection flange of said at least one more axial piston pump coaxially connected with the first axial piston pump.

Preferably, an intermediate flange housing is provided between the first end of the guide plate and the at least one more axial piston pump.

These and other details of the present invention will be more fully understood upon reference to the accompanying drawings.

DETAILED DESCRIPTION OF THE PREFERRED EMBODIMENT

Figure 1:
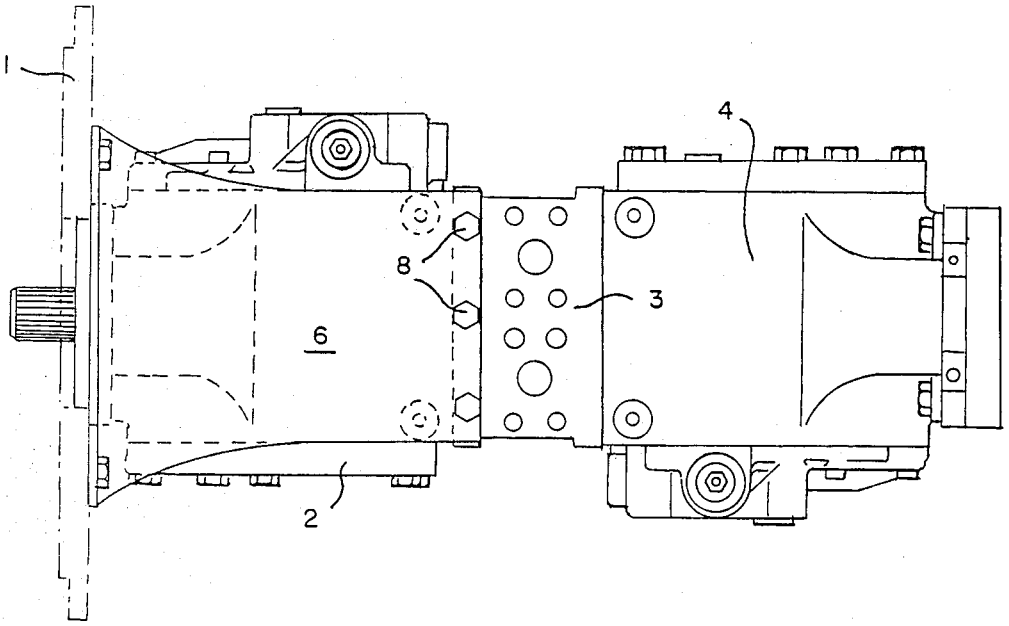
FIG. 1 is a side view of a multipump assembly according to the present invention.
Figure 2:
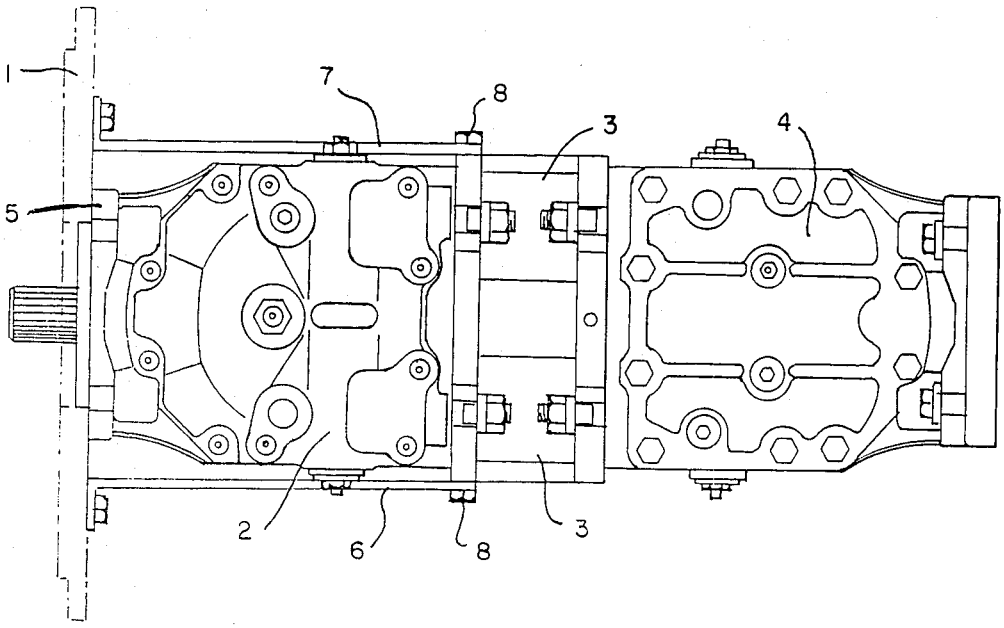
FIG. 2 is a plan view of the multipump assembly of FIG. 1.

A first axial piston machine 2 is flanged on the flange 1 (indicated by dot-dash lines) of a primary power source (not shown). An intermediate housing 3 is flanged on the end face of the housing of pump 2 facing away from flange 1.

Another axial piston pump 4 is flanged onto the housing 3; it is arranged coaxial to the axial piston pump 2 and its shaft is connected with the shaft of the axial piston pump 2. The flange of the axial piston pump 2 is connected directly with the flange 1 of the primary power source.

A guide or support plate 6 positioned at least approximately vertically is located alongside the axial piston pump 2 and another guide plate 7 is located on the other side of the axial piston pump 2. The two guide plates 6 and 7 are connected by bolts 8 with the intermediate housing 3.

Due to the fact that the two guide plates 6 and 7 are both at least approximately vertical and both are at least approximately parallel to each other, at the intermediate housing 3 they support the moment that results from the weight of the axial piston pump 4 around the flange 5. Because the two guide plates 6 and 7 are also at a distance from the shafts of the pumps 2 and 4, which are coaxial to each other, they also support the torque. On the other hand, they are flexible in the horizontal direction, such that no pinching can occur in this direction. The guide plates (stiffening plates) 6 and 7 thus have a bearing function without posing high requirements on the adjustment and without inducing the risk that additional stresses occur due to production tolerances in this design of the support. With reference to the moment resulting from the force of gravity, these guide plates 6 and 7 present a large resistance moment and thus furnish substantial supporting force, while they are flexible in the other direction. Such support plates can also be readily built on afterwards without structural changes or at least without necessitating substantial structural changes.

I claim:

1. A pump assembly including a primary power source having a primary power source connection flange thereon, a first axial piston pump attached to said primary power source flange, said first piston pump having a first pump connection flange thereon, at least one more axial piston pump coaxially connected to said first pump flange, said at least one more axial piston pump also having a connection flange thereon, a generally vertical guide plate positioned on at least one side of the first axial piston pump, said guide plate having a first end connected directly on the primary power source flange, and having an opposite end connected with the connection flange of said at least one more axial piston pump coaxially connected with the first axial piston pump.

2. A pump assembly according to claim 1, wherein an intermediate flange housing is provided between the first end of the guide or support plate and the at least one more axial piston pump.

* * * * *

UNITED STATES PATENT AND TRADEMARK OFFICE

CERTIFICATE OF CORRECTION

PATENT NO. : 4,854,826

DATED : August 8, 1989

INVENTOR(S) : Gustav Kleineisel

It is certified that error appears in the above-identified patent and that said Letters Patent is hereby corrected as shown below:

Column 2, line 18, after "flange" add --5--.

Column 2, line 42, after "furnish" add --a--.

Signed and Sealed this

Seventeenth Day of July, 1990

*Attest:*

HARRY F. MANBECK, JR.

*Attesting Officer*

*Commissioner of Patents and Trademarks*